United States Patent [19]

Kobayashi et al.

[11] Patent Number: 4,668,560

[45] Date of Patent: May 26, 1987

[54] SUBLIMATION TRANSFER TYPE COLOR HARD-COPY PRINTING PAPER

[75] Inventors: Naotake Kobayashi; Tetsuya Abe, both of Utsunomiya; Yoshio Fujiwara, Shimotsuga, all of Japan

[73] Assignee: Sony Corporation, Tokyo, Japan

[21] Appl. No.: 802,993

[22] Filed: Nov. 29, 1985

Related U.S. Application Data

[63] Continuation of Ser. No. 552,033, Oct. 31, 1983, abandoned.

[30] Foreign Application Priority Data

Mar. 2, 1982 [JP] Japan ..... 57-32611

[51] Int. Cl.[4] ..... B41M 5/26

[52] U.S. Cl. ..... 428/195; 8/471; 428/413; 428/475.5; 428/479.6; 428/480; 428/481; 428/536; 428/913; 428/914; 430/945

[58] Field of Search ..... 8/470, 471; 346/210–212; 428/201, 207, 211, 336, 412, 413, 475.5, 479.6, 480, 481, 514, 522, 536, 690, 704, 913, 914, 918, 195; 430/945

[56] References Cited

U.S. PATENT DOCUMENTS

| | | | |
|---|---|---|---|
| 4,406,662 | 9/1983 | Beran et al. | 8/471 |
| 4,474,859 | 10/1984 | Oshima et al. | 428/913 |
| 4,490,435 | 12/1984 | Oshima et al. | 8/471 |

FOREIGN PATENT DOCUMENTS

| | | | |
|---|---|---|---|
| 0020159 | 4/1982 | Japan | 428/914 |
| 0076298 | 5/1984 | Japan | 428/914 |

*Primary Examiner*—Bruce H. Hess

*Attorney, Agent, or Firm*—Hill, Van Santen, Steadman & Simpson

[57] ABSTRACT

The present invention relates to a sublimation transfer system color hard-copy printing paper and its object is to present an optimum coloring when the color hard-copying according to the subtractive color mixing process is carried out. To this end, the sublimation transfer system color hard-copy printing paper according to the present invention is provided at least on its surface with a resin layer containing a metal compound selected from Al, Mg, Ca and Sn wherein the sublimation dye is transferred and then colored on this resin layer.

7 Claims, No Drawings

SUBLIMATION TRANSFER TYPE COLOR HARD-COPY PRINTING PAPER

This is a continuation, of application Ser. No. 552,033, filed Oct. 31, 1983 now abandoned.

TECHNICAL FIELD

The present invention relates to a sublimation transfer type color hard-copy printing paper which is subjected to a treatment suitable for color-copying according to the thermal transfer of sublimation dye.

BACKGROUND ART

A dye having a relatively superior color forming property which is suitable for the sublimation, transfer and printing of dye is found much in a disperse dye, a basic dye and a solvent dye. However, when such dye is used as a dye carrier paper, almost all is limited to the dispersion dye. Although there are some of solvent dye having the chemical structure partially analogus to that of the dispersion dye suitable for such dye, the kind of dyes is limited to several tens in all. In order to obtain a dye carrier paper suitable for color hard-copying from such limited dye, when the dye is classified into three primary colors, cyan, magenta and yellow according to the subtractive mixture process, the kinds thereof are limited further. On the other hand, when the dye carrier paper made by using the dyes of limited kinds is heated to sublimate the dye and effectively transfer the dye to the printing paper, it is necessary to treat the surface of paper, which will become the printing paper, by resin having a high dyeing effect. As described before, since almost all of the dyes suitable for such purpose are the dispersion dye, it is desired that a resin used in the coating composition is such one that can effectively be dyed with the dispersion dye, namely, the resin represented by polyester resin, epoxy resin, acetate resin, nylon resin and so on. Also, it is known that if necessary, in order to remove irregularity of textile on the surface of the paper and to increase uniformity thereof, raise white degree of the paper surface and to increase the dyeing area of dye, the coating composition in which inorganic particles of a predetermined amount are dispersed is coated thin on the surface of the paper. Since the sublimation and dyeing property of the dye changes a little depending on various factors such as molecular weight, size of molecule, chemical structure, substitution radical, polarity, sublimation pressure, diffusion speed in the treatment resin layer, saturation dyeing amount, substituted radical of the dye and so on, the selection range of the kinds of the dye thus limited is somewhat widened in practice. However, in the prior art, when the hue of the dye which is transferred and dyed on the treated printing paper is examined, particularly magenta color is moved to reddish color side frequently. Thus, among red, green and blue as three primary colors according to the subtractive mixture process, particularly red tends to become yellowish, namely to form color close to orange color. For this reason, it is desired that the color forming of the red dye is controlled to move to the bluish side and thereby the color forming of magenta optimum for mixing and forming the colors can be selected. In this case, although a mixed dye method in which the red dye and the blue dye are mixed with a proper mixing ratio is considered, such method has defects that since it is difficult to make the sublimation speeds and the color forming concentrations of dyes of two kinds perfectly equal to each other, the color is not formed uniformly and that the hue is greatly displaced by the change of the color forming concentration and so on.

DISCLOSURE OF THE INVENTION

The present invention is to provide a sublimation transfer system color hard-copying printing paper which can solve the above problems and which can arbitrarily control the color forming of the red dye to move to the bluish side to thereby form magenta color having a high saturation.

According to a printing paper of the present invention, there is provided a sublimation transfer type color hard-copying printing paper formed by coating thin and uniformly on the surface of paper a resinous coating composition in which into a resin liquid composed mainly of a resin to facilitate the dyeing and diffusion of a sublimation dye represented such as polyester resin, epoxy resin, cellulose acetate resin, nylon resin and so on is dispersed or dissolved a metal compound selected from Al, Mg, Ca and Sn or if necessary, inorganic particles are added thereto in order to raise uniformity of the surface of the paper, the white degree and the dye adsorption area. In this case, the magenta can be controlled arbitrarily.

A metal compound utilized in the present invention can be a metal compound of Al, Mg, Ca and Sn. The above metal compound means a compound of organic acid such as oleic acid, naphthenic acid, stearic acid, 2-ethyl pentanoic acid or the like with the above metals, or metal salt of organic acid such as aluminium oxide acylate compound, for example, aluminium oxide stearate and so on, metal alcoholate such as aluminium isopropylate, aluminium butylate and so on which are the reaction product of alcohol such as ethyl alcohol, isopropyl alcohol, butyl alcohol, 2-ethyl hexyl alcohol and so on with Al, chelate compound between acetyl acetnate and metal such as aluminium acetnate or the like or highly-activated magnesium oxide or the like having an activation value (iodine adsorption amount) higher than 100. In the oxide, a highly-stable compound having an activation value less than 100 does not contribute to the effect which shifts the color forming of magenta to the blue side.

The reason why the color forming of the sublimation red dye according to the present invention can be controlled to the bluish hue is not clear. However, this can be considered that since almost all of the red dyes having high sublimation dyeing property are anthraquinone type dispersion dyes, amino group, hydroxyl group and so on which are polar groups in the anthraquinone type dye are reacted with the activated metal atoms in the metal compound of the present invention to thereby produce, for example, chelate compound and so on with a result that a molecular blue color forming substance is increased uniformly.

According to the sublimation transfer system color hard-copy printing paper of the present invention, particularly magenta, in three primary colors, cyan, magenta and yellow on the basis of the subtractive mixture process can freely be controlled in hue without lowering the color saturation.

BEST MODE FOR CARRYING OUT THE INVENTION

Next, examples of the present invention will be described.

COMPARATIVE EXAMPLE 1

Coating composition made of 24 parts by weight of internally-plasticized saturated polyester resin (VILON #200, manufactured by Toyobo Co., Ltd.), 6 parts by weight of ultra fine particle silica (NIPSIL E220A, manufactured by Nippon Silica Industry Co., Ltd.) and 70 parts by weight of methyl ethyl ketone solvent was coated on one surface of a best quality paper having an area weight of 170 g/M$^2$ so as to have a coating amount of approximately 5 g/M$^2$ after being dried, and thereby a sublimation transfer color hard-copying printing paper was obtained. Then an ink made of 6 parts by weight reddish anthraquinone type dispersion dye having a sublimation property (PTR 63, manufactured by Mitsubishi Chemical Industries Co., Ltd.), 6 parts by weight of ethyl cellulose and 88 parts by weight of isopropyl alcohol solvent was coated on a paper having an area weight of 40 g/M$^2$ by a gravure coater so as to have a coating weight of 5 g/M$^2$ after being dried and thereby a dye carrier paper was made. And, the dye carrier paper and the printing paper thus made were located in contact with each other. Under this state, the dye carrier paper was pressed and heated from its back side for three seconds by a thermal print head having a predetermined temperature of 200° C. whereby the dye was transferred and colored on the treated surface of the printing paper.

COMPARATIVE EXAMPLE 2

A coating composition made of 24 parts by weight of solid epoxy resin (EPICOAT 1009, manufactured by Shell Kagaku Kabushiki Kaisha), 6 parts by weight of ultra fine particle silica (NIPSIL E220A) and 70 parts by weight of methyl ethyl ketone solvent was coated in the same way as in the comparative example 1 and a printing paper was obtained. Then, the printing paper was employed and under the same condition as the comparative example 1, dye was transferred and colored thereon.

EXAMPLE 1

A coating composition was made by adding 2.5 g of ethyl acetacetate aluminium diisopropylate (ALCH, manufactured by Kawaken Fine Chemical Co., Ltd.) into the coating composition made in the comparative example 1 and a printing paper was made in the same way as in the comparative example 1. Then, the dye carrier paper used in the comparative example 1 was used, and under the same condition, a dye was transferred and colored on the treated surface of the printing paper.

EXAMPLE 2

A coating composition was made by adding into and dispersing 2 g of highly-activated magnesium oxide having an activation value (iodine adsorption amount) ranging from 130 to 170 (KYOWA MAG 150, manufactured by Kyowa Chemical Industry, Co., Ltd.) into the coating composition made in the comparative example 1. Then, this composition was employed to form a printing paper in the same way as the comparative example 1 and to thus treated surface of the printing paper the dye was transferred from the dye carrier paper and then colored.

EXAMPLE 3

A coating composition was made by adding 3 g of calcium 2-ethyl hexoate (Octope "Ca", manufactured by (Hope Seiyaku Kabushiki Kaisha) into the coating composition of the comparative example 2. This composition was used to form a photo-printing paper in the same way as the comparative example 1 and to the treated surface of the printing paper the dye was transferred from the dye carrier paper and then colored.

EXAMPLE 4

A coating composition was made by adding 2.5 g of aluminium oxide stearate (Olive AOS, manufactured by Hope Seiyaku Kabushiki Kaisha) into the coating composition made in the comparative example 1 and a printing paper was formed according to the comparative example 1. Then, the dye carrier paper used in the comparative example 1 was used and under the same condition, the dye was transferred and then colored on the treated surface of the printing paper.

Subsequently, the printing paper thus transferred and colored were cut out and their hue was measured by a color difference meter ND-101DC type (manufactured by Nippon Denshoku Kogyo Kabushiki Kaisha). Then, the change of red color was indicated on the table 1 by x-value of chromaticity coordinate according to CIE (commission international de L'eclairage) color representing method.

TABLE 1

| Experiment Nos. | x value on CIE method |
|---|---|
| Comparative example 1 | 0.456 |
| Comparative example 2 | 0.440 |
| Example 1 | 0.362 |
| Example 2 | 0.355 |
| Example 3 | 0.395 |
| Example 4 | 0.360 |

Large value x on the CIE color representing method means the increase of red while small value means the increase of blue. As will be clear from the measured results on the table 1, when the printing paper according to the present invention is employed, as compared with the comparative examples, the value x becomes small and hence blue is increased. That is, it is understood that the coloring of the reddish coloring of magenta is suppressed. As a result, when this printing paper is used and the color hard-copying based on the subtractive mixture method is carried out, the optimum coloring can be obtained.

We claim:

1. A color hard-copy print comprising:

a printing substrate, a coating layer formed on one surface of said substrate, sublimation transfer dyes of the three primary colors selectively formed on said coating layer by thermal transfer of said dyes, said coating layer being composed of a resinous binder containing an organic acid salt of a metal selected from the group consisting of Al, Mg, Ca and Sn.

2. A print according to claim 1 wherein said resinous binder is a polyester resin, an epoxy resin, a cellulose acetate resin, or a nylon resin.

3. A print according to claim 1 wherein said organic acid salt is a metal alcoholate.

4. A print according to claim 1 wherein said organic acid salt is a metal chelate.

5. The method of making a color hard-copy print comprising the steps of:

providing a printing substrate having a coating layer on one surface thereof, and thermally transfering sublimation dyes of the three primary colors selectively onto said coating layer to form a hard-copy print, said coating layer including a resinous binder containing an organic acid salt of a metal selected from the group consisting of Al, Mg, Ca and Sn.

6. A method according to claim 5 wherein said organic acid salt is a metal alcoholate.

7. A method according to claim 5 wherein said organic acid salt is a metal chelate.

* * * * *